US010050377B2

(12) United States Patent
Matsuura et al.

(10) Patent No.: US 10,050,377 B2
(45) Date of Patent: Aug. 14, 2018

(54) CONNECTOR HAVING A DRAINAGE PORT

(71) Applicant: Sumitomo Wiring Systems, Ltd., Yokkaichi, Mie (JP)

(72) Inventors: Junya Matsuura, Mie (JP); Shinji Iihoshi, Mie (JP)

(73) Assignee: SUMITOMO WIRING SYSTEMS, LTD., Yokkaichi, Mie (JP)

( * ) Notice: Subject to any disclaimer, the term of this patent is extended or adjusted under 35 U.S.C. 154(b) by 0 days.

(21) Appl. No.: 15/800,337

(22) Filed: Nov. 1, 2017

(65) Prior Publication Data

US 2018/0123283 A1 May 3, 2018

(30) Foreign Application Priority Data

Nov. 2, 2016 (JP) ..... 2016-215142

(51) Int. Cl.
*H01R 4/60* (2006.01)
*H01R 4/64* (2006.01)
*H01R 13/52* (2006.01)

(52) U.S. Cl.
CPC ..... *H01R 13/5227* (2013.01)

(58) Field of Classification Search
CPC ..... H01R 13/5227; H01R 13/5202; H01R 13/6584; H01R 13/743
USPC ..... 439/205, 548, 556, 559
See application file for complete search history.

(56) References Cited

U.S. PATENT DOCUMENTS 8,597,039 B2 * 12/2013 Osawa ..... H01R 13/5227 439/205
8,662,910 B2 * 3/2014 Ichio ..... H01R 13/5208 439/206
9,352,660 B2 * 5/2016 Osawa ..... B60L 11/1818
9,478,899 B2 * 10/2016 Kurita ..... H01R 13/5227
2008/0096407 A1 4/2008 Lee et al.
2015/0325948 A1 * 11/2015 Kurita ..... H01R 13/5227 439/206

FOREIGN PATENT DOCUMENTS

JP 2008-103325 5/2008

* cited by examiner

*Primary Examiner* — Hae Moon Hyeon
(74) *Attorney, Agent, or Firm* — Gerald E. Hespos; Michael J. Porco; Matthew T. Hespos

(57) ABSTRACT

A connector (10) is provided with a waiting side housing (11) including a forwardly open receptacle (13) and is mounted in a mounting hole (H) of a panel (P). A fit-in side housing (30) includes a terminal accommodating portion (31) that can fit into the receptacle (13). Drainage ports (21) are formed in a lower wall (16) of the receptacle (13), and water guides (22) project into opening areas of the drainage ports (21) only from parts of opening edges of the drainage ports (21). Upper surfaces of the water guides (22) define water guiding surfaces (23) connected to an upper surface (16S) of the lower wall (16).

6 Claims, 11 Drawing Sheets

CONNECTOR HAVING A DRAINAGE PORT

BACKGROUND

Field of the Invention

The invention relates to a connector.

Description of the Related Art

Japanese Unexamined Patent Publication No. 2008-103325 discloses a connector with a waiting side housing provided in a mounting hole of a panel. The waiting side housing includes a laterally open receptacle and a fit-in side housing is fit into the receptacle. Terminal fittings in the housings could become wet if water penetrates into a clearance between the outer periphery of the fit-in side housing and the inner periphery of the receptacle and remains in that clearance. Accordingly, a seal may be provided between the inner periphery of the receptacle and the outer periphery of the fit-in side housing to prevent water penetration. However, the seal increases the number of components.

The invention was completed based on the above situation and aims to prevent water from remaining in a receptacle.

SUMMARY

The invention is directed to a connector with a waiting side housing and a fit-in side housing. The waiting side housing is mounted in a mounting hole of a panel and has a forwardly open receptacle. The fit-in side housing has a terminal accommodating portion that can fit into the receptacle. A drainage port is formed in a lower wall of the receptacle, and a water guide projects into an opening area of the drainage port only from a part of an opening edge of the drainage port. A water guiding surface is formed on the top of the water guide and is connected to an upper surface of the lower wall.

A water film may form in an area of the upper surface of the lower wall adjacent to the drainage port. However, that water film is pulled toward the water guiding surface due to surface tension and is discharged to the outside of the receptacle from the opening area of the drainage port. Thus, water will not remain in the receptacle.

The water guiding surface may be inclined down into the opening area of the drainage port from the opening edge of the drainage port. This inclination of the water guiding surface improves drainage efficiency.

The water guiding surface may be connected at an obtuse angle to the upper surface of the lower wall. Thus, a water film on the upper surface of the lower wall easily transfers to the water guiding surface.

The water guiding projection may have a flow-down surface extending down from a projecting end of the water guiding surface. According to this configuration, a water film pulled onto the water guiding surface is pulled toward the flow-down surface from the projecting end of the water guiding surface and is discharged reliably.

A reinforcing portion may project from a lower surface of the lower wall and may be connected to a lower part of the water guiding projection. According to this configuration, the water guiding projection will not deform even if an external matter interferes with the water guiding projection exposed on an outer surface of the receptacle.

The receptacle may include a back wall connected to a rear end part of the lower wall, and the drainage port also may open in a lower part of the back wall. The back wall portion may be formed with an auxiliary water guide projecting down into the opening area of the drainage port only from a part of an upper edge part constituting the opening edge of the drainage port. Thus, water that has run down along the back wall forms a water film in an area adjacent to the upper part of the opening edge of the drainage port and is pulled into the drainage port by the auxiliary water guiding projection and discharged.

DETAILED DESCRIPTION

Figure 1:
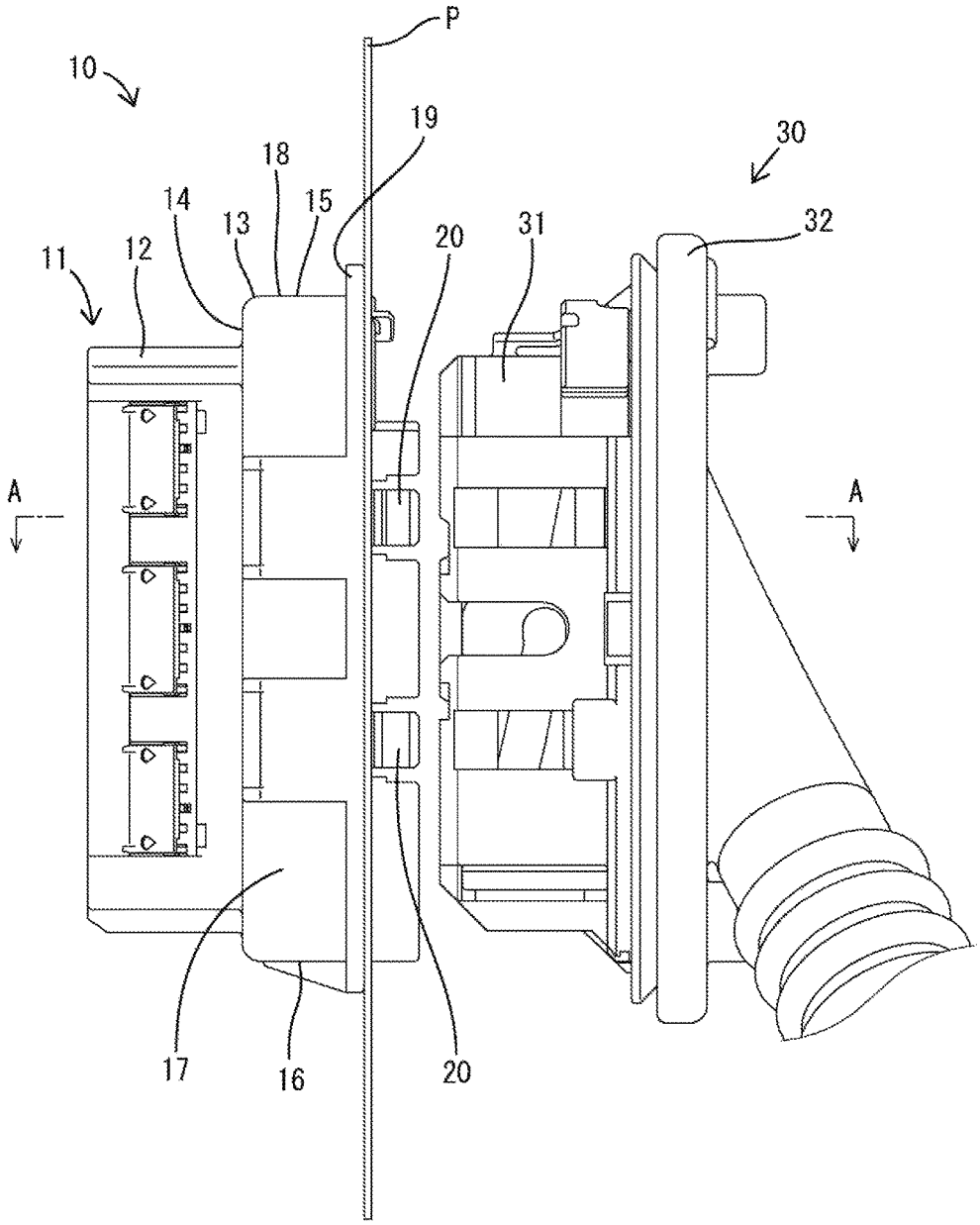
FIG. 1 is a side view showing a state where a waiting side housing and a fit-in side housing are separated in a connector of a first embodiment.
Figure 5:
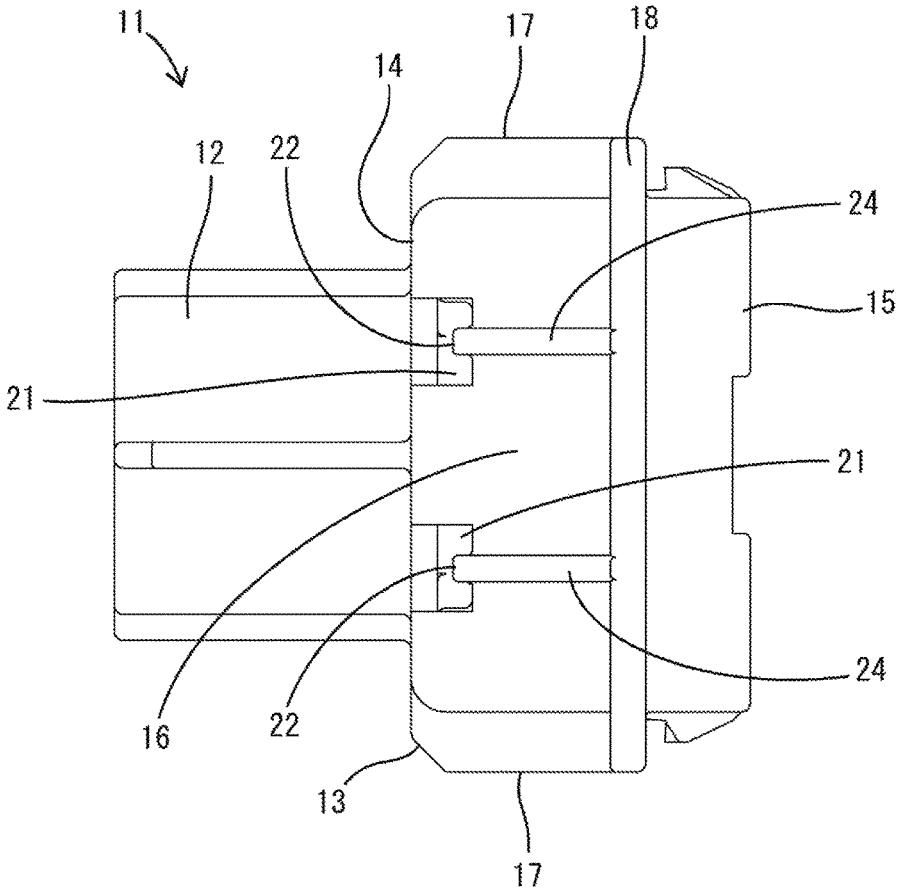
FIG. 5 is a bottom view of the waiting side housing.
Figure 6:
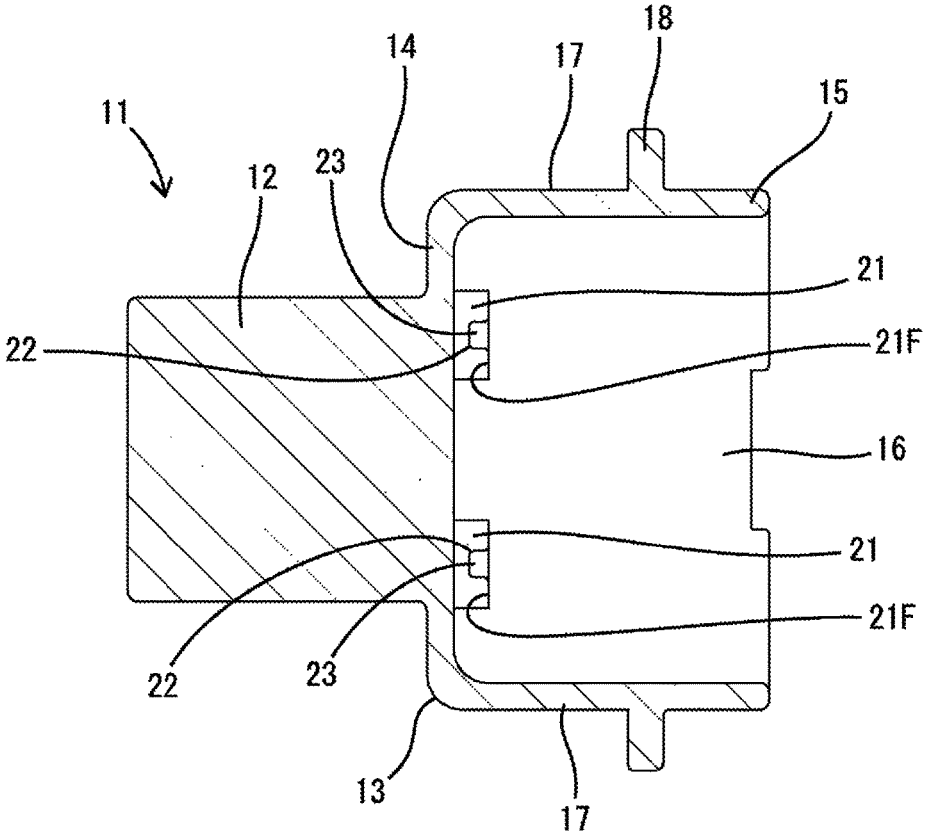
FIG. 6 is a section along B-B of FIG. 4.
Figure 7:
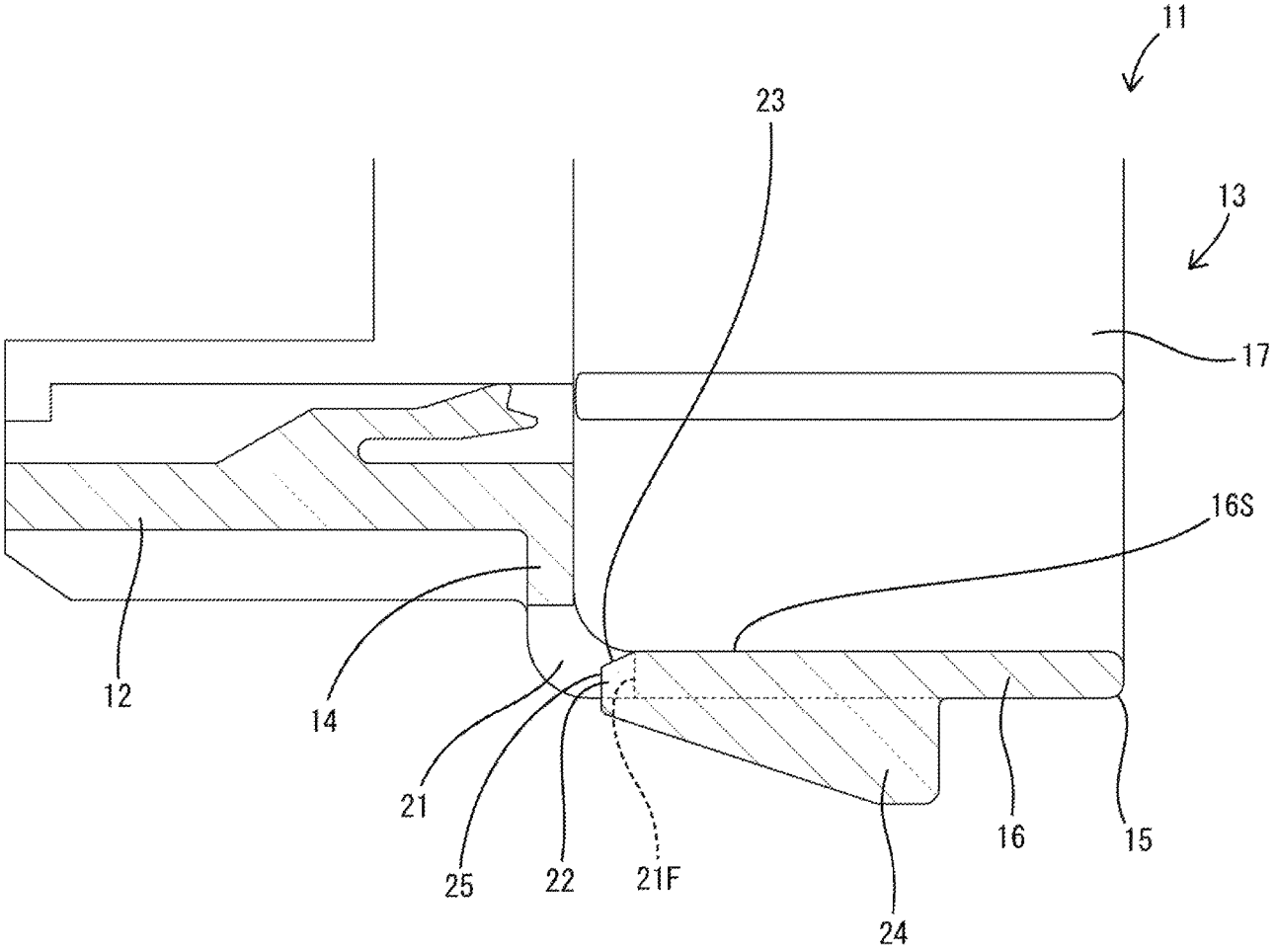
FIG. 7 is a partial enlarged section along C-C of FIG. 4.
Figure 8:
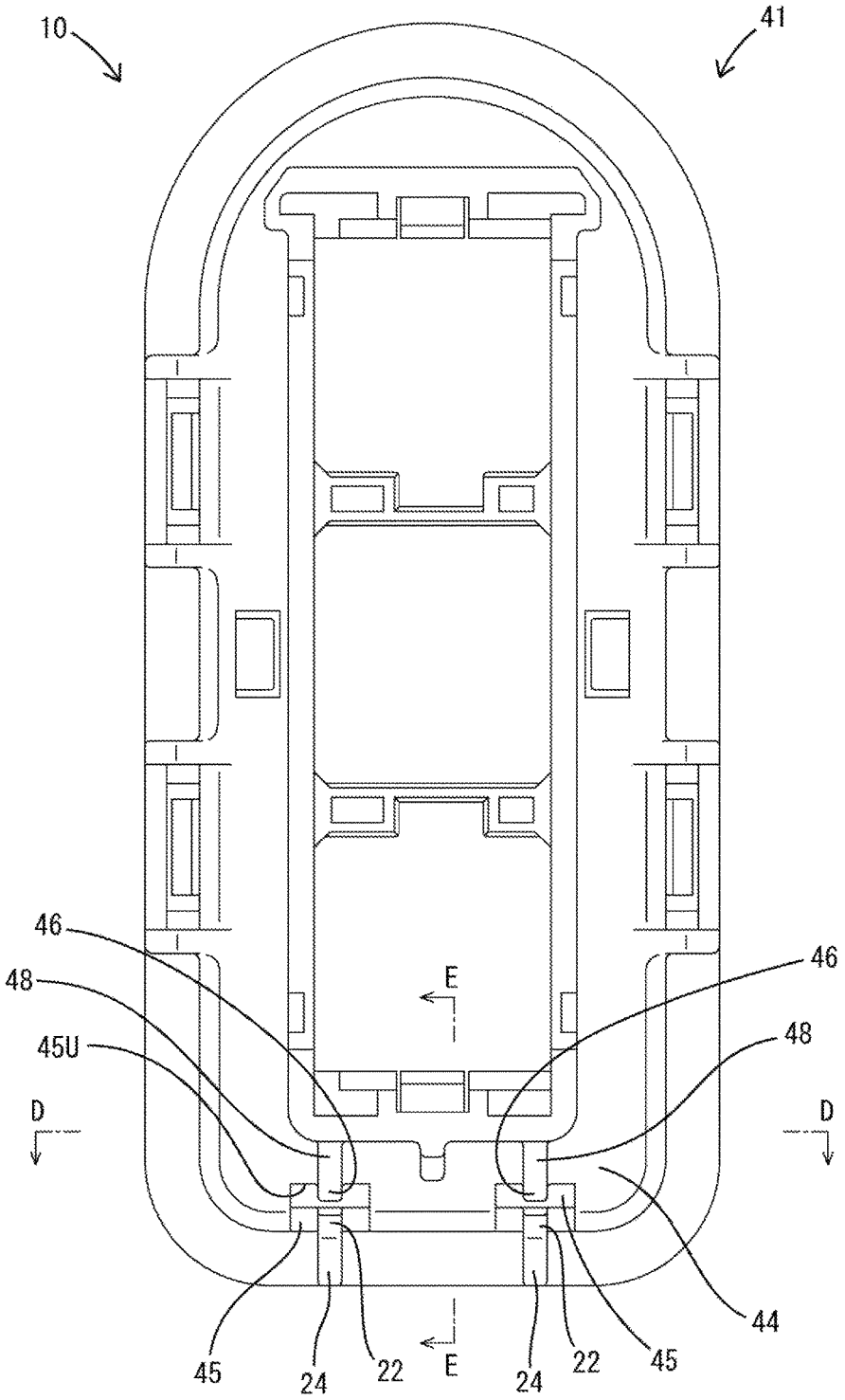
FIG. 8 is a back view of a waiting side housing of a connector of a second embodiment.
Figure 9:
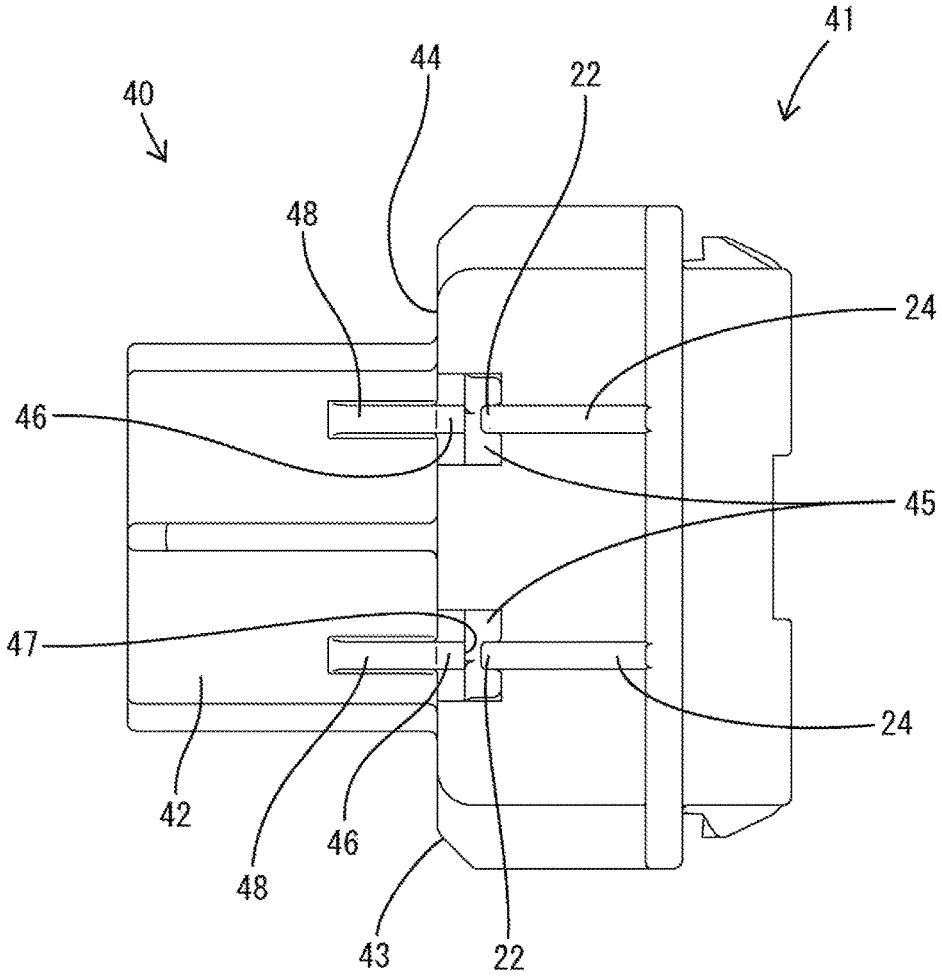
FIG. 9 is a bottom view of the waiting side housing of the second embodiment.
Figure 10:
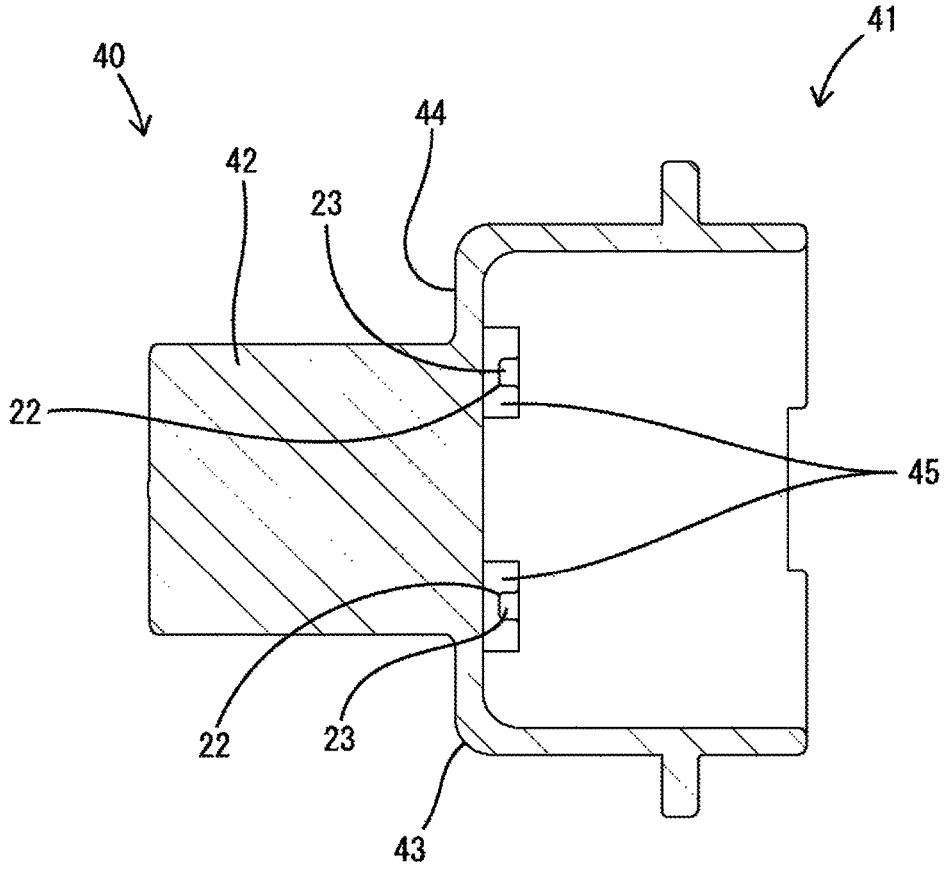
FIG. 10 is a section along D-D of FIG. 8.
Figure 11:
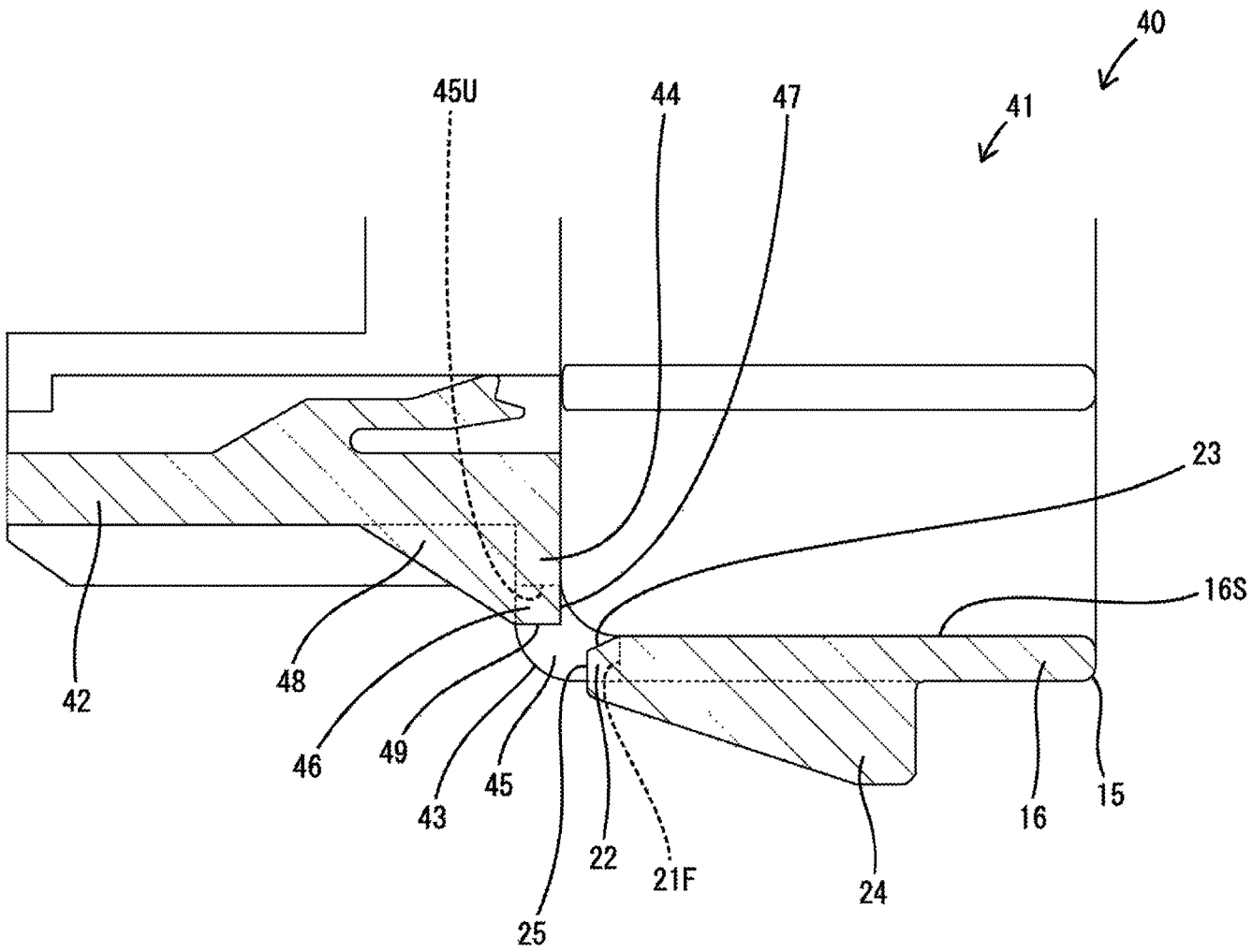
FIG. 11 is a partial enlarged section along E-E of FIG. 8.

A first embodiment of the invention is described with reference to FIGS. 1 to 7. In the following description, a right side in FIGS. 1 to 3 and 5 to 7 is referred to as a front concerning a front-rear direction. Upper and lower sides shown in FIGS. 1, 4 and 7 are defined as upper and lower sides concerning a vertical direction.

Figure 2:
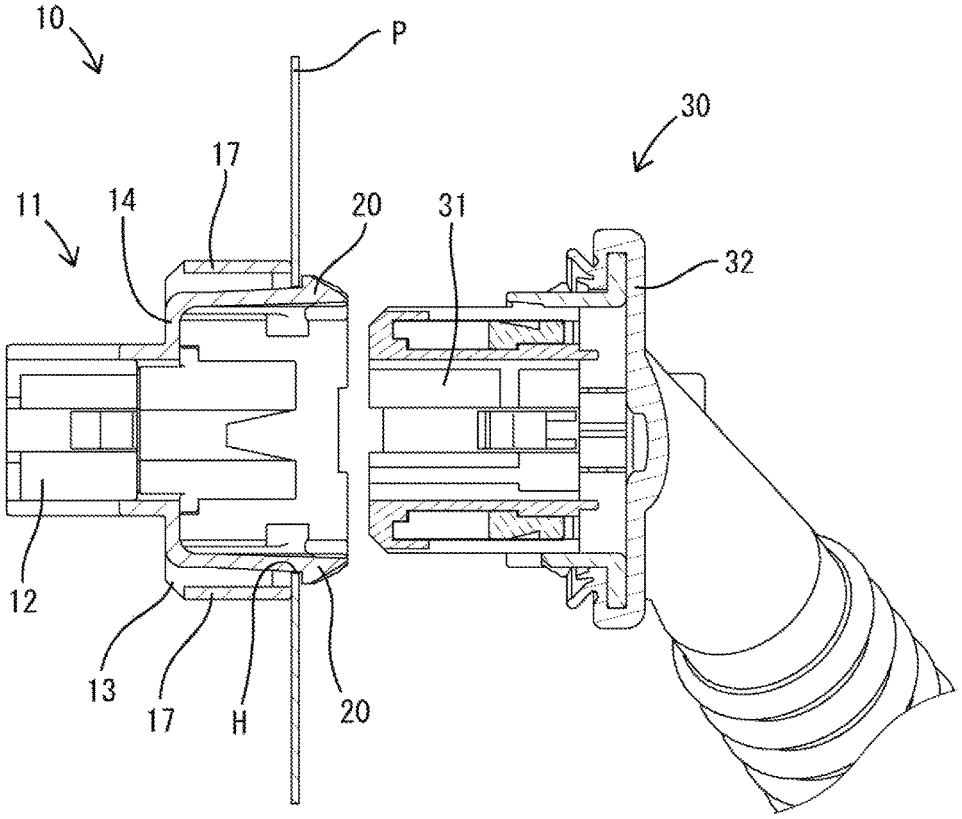
FIG. 2 is a section along A-A of FIG. 1.
Figure 3:
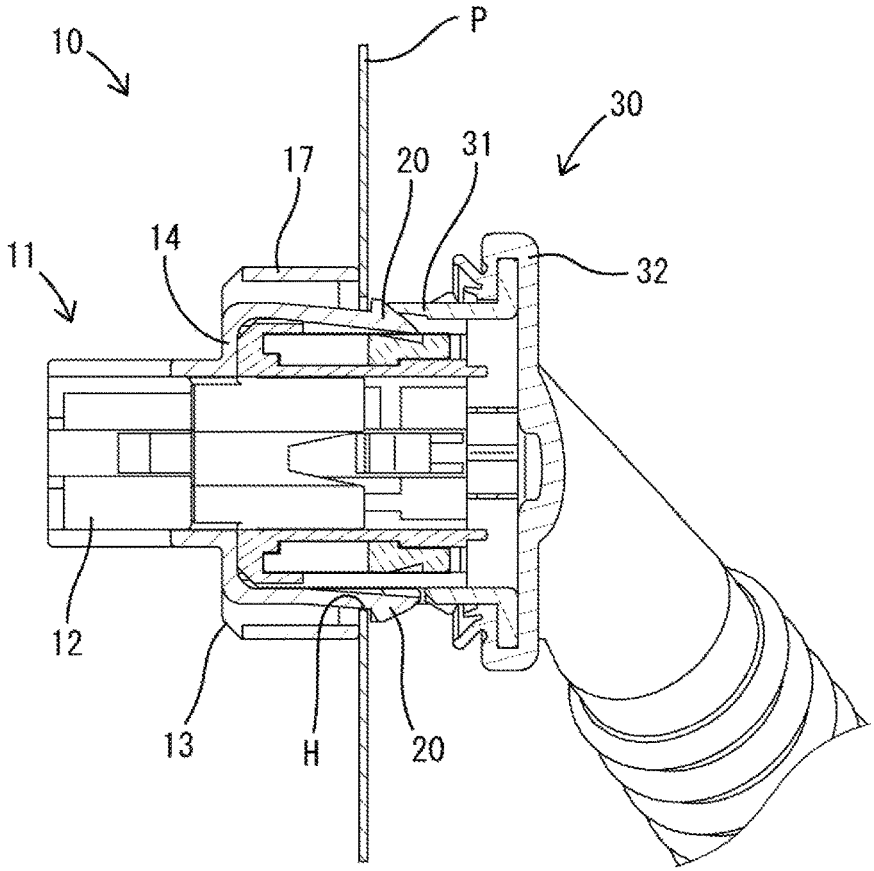
FIG. 3 is a section along A-A showing a state while the waiting side housing and the fit-in side housing are being connected.
Figure 4:
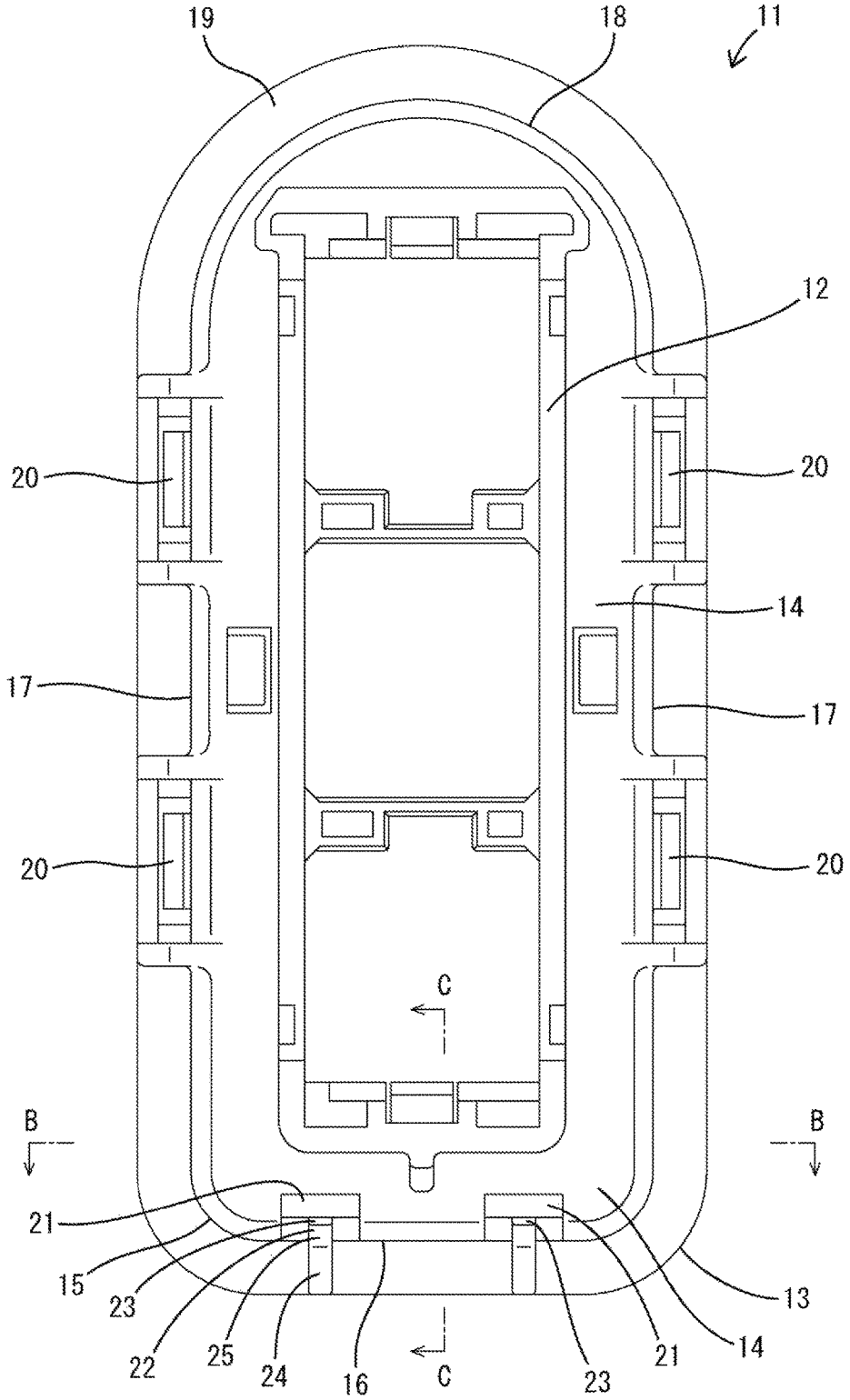
FIG. 4 is a back view of the waiting side housing.

A connector 10 of the first embodiment includes a waiting side housing 11 mounted in a mounting hole H of a panel P and a fit-in side housing 30 connectable to the waiting side housing 11, as shown in FIGS. 1 to 3. The waiting side housing 11 includes a terminal holding portion 12 for holding a plurality of male terminal fittings (not shown) and a receptacle 13 extending forward from the front end of the terminal holding portion 12.

The receptacle 13 includes a back wall 14 protruding like a flange over the entire periphery from the outer peripheral edge of the front end of the terminal holding portion 12 and a tubular portion 15 projects forward from the outer periphery of the back wall 14. The tubular portion 15 has a lower wall 16, left and right side walls 17 extending up from left and right sides of the lower wall 16 and an upper wall 18 coupling upper end ends of the left and right side walls 17. A contact flange 19 is formed on the outer periphery of a front part of the tubular portion 15 and is configured to contact an edge of the mounting hole H at the rear surface of the panel P. Resilient locking pieces 20 are cantilevered forward from the back wall 14 of the receptacle 13 and extend along the inner surfaces of the left and right side walls 17.

The waiting side housing 11 is held on the panel P by aligning an opening on the front end of the receptacle 13 with the mounting hole H, bringing the contact flange 19 into contact with the rear surface of the panel P and locking retaining projections of the resilient locking pieces 20 to an edge of the mounting hole H on the front surface of the panel. Further, the resilient locking pieces 20 are resiliently in contact with the edge of the mounting hole H. Thus, the waiting side housing 11 will not separate from the panel P even if the panel P or the waiting side housing 11 is subjected to vibration or an external force acts on the waiting side housing 11 from the front.

The fit-in side housing 30 includes a terminal accommodating portion 31 for accommodating female terminal fittings (not shown). The fit-in side housing 30 is connected to the waiting side housing 11 so that the terminal accommodating portion 31 is accommodated into the receptacle 13 from the front of the waiting side housing 11. A resilient grommet 32 is mounted on a back surface (side opposite to the waiting side housing 11 in the front-rear direction) of the fit-in side housing 30 and functions as a waterproofing means.

The grommet 32 closely contacts an area of the front surface of the panel P surrounding the entire periphery of the mounting hole H in a light-tight manner when the housings 11, 30 are connected properly. The grommet 32 prevents water penetration into a connected part of the housings 11, 30 on the front surface of the panel P and into a clearance between the mounting hole H and the receptacle 13 from the front of the panel P.

No sealing means is provided in a clearance between the rear surface of the panel P and the contact flange 19 of the waiting side housing 11. Therefore, water may penetrate into the receptacle 13 from the clearance between the rear surface of the panel P and the contact flange 19. As a countermeasure, the lower wall 16 of the receptacle 13 has left and right drainage ports 21 to allow communication between the inside of the receptacle 13 (upper surface 16S of the lower wall 16) and the outside of the receptacle 13 (lower part of the lower wall 16 and rear part of the back wall 14).

The drainage ports 21 are open from a rear part of the lower wall 16 to a lower part of the back wall 14. As shown in FIGS. 5 and 6, an opening area of the drainage port 21 in a plan view has a substantially rectangular shape longer in a lateral direction than in the front-rear direction. As shown in FIG. 4, the opening area of the drainage port 21 in a back view has a substantially rectangular shape longer in the lateral direction than in the vertical direction. A formation range in the lateral direction of the opening area in the plan view is the same as a formation range in the lateral direction of the opening area of the drainage port 21 in the back view, and these opening areas communicate to form one opening.

Part of water that penetrates into the receptacle 13 and runs down along the inner surface of the back wall 14 is dripped down to the outside of the receptacle 13 from the opening areas of the drainage ports 21 in the back wall 14. Further, water that penetrates into the receptacle 13 and runs down along the inner surfaces of the back wall 14 and the side walls 17 forms a water film (not shown) on the upper surface 16S of the lower wall 16 (inner surface of the receptacle 13). If the water film is adjacent to the drainage port 21, that water film is discharged to the outside of the receptacle 13 from the drainage port 21.

In the first embodiment, water guides 22 are formed on the lower wall 16 as a means for improving drainage efficiency from the drainage ports 21. As shown in FIGS. 5 to 7, the water guides 22 are cantilevered to project rearward into the opening areas from a front edge 21F at the opening of the respective drainage ports 21 in the lower wall 16. The front edge 21F extends straight in the lateral direction.

The water guide 22 is disposed on a part of the front edge 21F, i.e. only at a laterally central position of the front edge 21F. Thus, a width (lateral dimension) of the water guide 22 is smaller than that of the opening area of the drainage port 21. Further, the water guide 22 is formed only on the front edge 21F and is not formed on side edge. Only one water guide 22 is formed in one drainage port 21.

The upper surface of the water guide 22 serves as a water guiding surface 23 inclined down toward the projecting end thereof (opening area). The entire area of the water guiding surface 23 is formed only by one flat surface that has a constant angle of inclination. The front end (base end) of the water guiding surface 23 is connected at an obtuse angle to the upper surface 16S of the lower wall 16. Thus, no step is present on a boundary between the upper surface 16S of the lower wall 16 and the water guiding surface 23.

The receptacle 13 is formed with left and right reinforcing ribs 24 individually connected to the respective water guiding projections 22. Each reinforcing rib 24 projects from the lower surface (outer surface) of the lower wall 16 and extends long in the front-rear direction. A formation area of the water guide 22 and a formation area of the reinforcing ribs 24 match in the lateral direction (width direction), and a rear end part of each reinforcing rib 24 is connected to a lower part of the water guide 22. Further, the rear end surface of the water guide 22 and that of the reinforcing rib 24 define a vertical flow-down surface 25. The upper end of the flow-down surface 25 is connected at an obtuse angle to the rear end of the water guiding surface 23.

A water film that forms in an area of the upper surface 16S of the lower wall 16 in front of the drainage port 21 may reach the front edge 21F of the drainage port 21 may contact a front end of the water guiding surface 23 that is narrower than the front edge 21F. This water film then is pulled toward the water guiding surface 23 from the upper surface 16S of the lower wall 16 due to surface tension. Further, the water guiding surface 23 is inclined down and away from an area of the lower wall 16 where the water film is present (into the opening area of the drainage port 21). Thus, the water film on the lower wall 16 is pulled into the opening area of the drainage port 21 due to the surface tension and the inclination of the water guiding surface 23 and is discharged reliably down to the outside of the receptacle 13 from the drainage port 21.

The connector 10 of the first embodiment includes the waiting side housing 11 having the forwardly open receptacle 13 mounted in the mounting hole H of the panel P, and the fit-in side housing 30 having the terminal accommodating portion 31 that fits into the receptacle 13. The lower wall 16 of the receptacle 13 is formed with the drainage ports 21, and the water guides 22 project into the opening areas of the drainage ports 21 only from the front edges 21F of the drainage ports 21. The upper surfaces of the water guides 22 form the water guiding surfaces 23 connected to the upper surface 16S of the lower wall 16.

According to this configuration, if a water film is formed in an area of the upper surface 16S of the lower wall 16 adjacent to the front edge 21F of the drainage port 21, surface tension larger than that on the upper surface 16S of the lower wall 16 is generated on the narrow water guide 22 (water guiding surface 23) projecting from the front edge 21F into the opening area of the drainage port 21. Due to this surface tension, the water film on the lower wall 16 is pulled toward the water guiding surface 23 and discharged to the outside of the receptacle 13 from the opening area of the drainage port 21. Thus, water is prevented from remaining in the receptacle 13 on the upper surface 16S of the lower wall 16.

The water guiding surface 23 inclines down into the opening area of the drainage port 21 from the front edge 21F of the drainage port 21 to improve drainage efficiency. Further, since the water guiding surface 23 is connected at an obtuse angle to the upper surface 16S of the lower wall 16, the water film on the upper surface 16S of the lower wall 16 easily transfers to the water guiding surface 23. Further, since the water guiding projection 22 has the flow-down surface 25 extending down from the projecting rear end of the water guiding surface 23, the water film pulled onto the water guiding surface 23 is discharged reliably by being pulled toward the flow-down surface 25 from the projecting end of the water guiding surface 23.

The water guides 22 project into the opening areas open in the outer surface (lower surface) of the lower wall 16 of the receptacle 13. External matter could interfere with the water guide 22 if the water guides 22 were exposed on the outer surface of the lower wall 16. However, the reinforcing ribs 24 are formed on the lower surface of the lower wall 16 and are connected to the entire areas of the lower end parts of the water guides 22. These reinforcing ribs 24 project from the lower surface (outer surface) of the lower wall 16 and enhance the rigidity of the water guides 22. Thus, even if external matter interferes with the water guides 22, the water guides 22 will not deform. Further, the rear end parts of the reinforcing ribs 24 prevent external matter from interfering with the water guides 22 from below.

A second embodiment of the invention is described with reference to FIGS. 8 to 11. A connector 40 of the second embodiment differs from the connector 10 of the first embodiment in that auxiliary water guides 46 are added on a back wall 44 of a receptacle 43 of a waiting side housing 41 and auxiliary reinforcing ribs 48 are added on a terminal holding portion 42 of the waiting side housing 41. Parts that are the same as the above first embodiment are denoted by the same reference signs and are not described.

The auxiliary water guides 46 are cantilevered down into opening areas of drainage ports 45 in the back wall 44 from upper edges 45U of the opening areas. The front surface (surface facing the receptacle 13) of the auxiliary water guiding projection 46 defines an auxiliary water guiding surface 47 continuous and flush with the front surface of the back wall 44 (inner surface of the receptacle 43). A formation range of the auxiliary water guide 46 matches a formation range of the water guide 22 in the lateral direction. Thus, the auxiliary water guide 46 is narrower than the upper edge 45U.

The auxiliary reinforcing rib 48 projects down from the lower surface of the terminal holding portion 42 and also projects from the rear outer surface of the back wall 44. Formation areas of the auxiliary water guide 46 and the auxiliary reinforcing rib 48 match in the lateral direction, and a front end part of the auxiliary reinforcing rib 48 is connected to a rear end part of the auxiliary water guide 46. Further, the lower projecting end surface of the auxiliary water guide 46 and the lower end surface of the auxiliary reinforcing rib 48 form a horizontal edge trimming surface 49. The front end of the edge trimming surface 49 is connected at a right angle to the lower end of the auxiliary water guiding surface 47.

Water that penetrates into the receptacle 43 and runs down along the inner front surface of the back wall 44 reaches the upper edge 45U of the drainage port 45 in the back wall 44 and contacts an upper end part of the auxiliary water guiding surface 47 that is narrower than the upper edge part 45U. Thus, a water film is pulled toward the auxiliary water guiding surface 47 from the inner surface of the back wall 44 due to surface tension. This causes the water film to drip down to the outside of the receptacle 43 from the opening area. Further, the horizontal edge trimming surface 49 is connected at a right angle on the lower end of the vertical auxiliary water guiding surface 47. Thus, water that reaches the lower end of the auxiliary water guiding surface 47 reliably separates from the auxiliary water guiding surface 47 and falls down.

As described above, in the connector 40 of the second embodiment, the receptacle 43 includes the back wall 44 connected to a rear end part of the lower wall and the drainage ports 45 also open in the lower end part of the back wall 44. The back wall 44 is formed with the auxiliary water guiding projections 46 projecting down into the opening areas of the drainage ports 45 from only parts of the upper edge parts 45U constituting the opening edges of the drainage ports 45. According to this configuration, water that runs down along the back wall 44 forms a water film in an area adjacent to the upper edge part 45U of the opening edge of the drainage port 45 and is pulled into the drainage port 45 by the auxiliary water guide 46 and discharged.

Further, since the auxiliary water guides 46 project into the opening areas open in the outer surface of the back wall 44 of the receptacle 43. External matter could interfere with the auxiliary water guides 46 if the auxiliary water guides 46 were exposed on the outer surface of the back wall 44. However, the auxiliary reinforcing ribs 48 are formed on the outer surface of the back wall 44 and are connected to the entire areas of the rear end parts of the auxiliary water guiding projections 46. These auxiliary reinforcing ribs 48 project from the outer surface of the back wall 44 and enhance the rigidity of the auxiliary water guides 46. Thus, external matter will not deform the auxiliary water guides 46. Further, the auxiliary reinforcing portions 48 reduce the chance of external matter interfering with the auxiliary water guiding projections 46 from the rear.

The invention is not limited to the above described and illustrated embodiments. For example, the following embodiments are also included in the scope of the invention.

The water guiding surfaces incline down toward the opening areas of the drainage ports in the first and second embodiments, but the water guiding surfaces may be horizontal.

The entire area of the water guiding surface is formed by only one flat surface in the first and second embodiments. However, the water guiding surface may have: plural flat surfaces at different angles to a horizontal plane; one curved surface; plural curved surfaces having different curvatures; or a flat surface and a curved surface.

The water guiding surface is connected at an obtuse angle to the upper surface of the lower wall in the first and second embodiments, but the water guiding surface may be connected to the upper surface of the lower wall with a step formed therebetween.

The water guide projects from the widthwise center of one straight front part of the opening edge of the drainage port in the first and second embodiments, but the water guide may project from a position other than the widthwise center on the front edge of the drainage port.

Although the water guide is formed only on the front part of the opening edge of the drainage port in the first and second embodiments, the water guide may be formed on side parts and/or a rear part of the opening edge of the drainage port.

The receptacle is formed with the reinforcing portions connected to the water guides in the first and second embodiments, the receptacle may not include the reinforcing portions.

Although the drainage ports are open in the lower wall and the back wall in the above embodiments, the drainage ports may be open only in the lower wall.

Although one water guiding projection is formed in one drainage port in the first embodiment, plural water guides may project in one drainage port.

Although two water guides project in one drainage port in the second embodiment, three or more water guides may be project in one drainage port.

LIST OF REFERENCE SIGNS

P . . . panel
H . . . mounting hole
10, 40 . . . connector
11, 41 . . . waiting side housing
13, 43 . . . receptacle
14, 44 . . . back wall
16 . . . lower wall
16S . . . upper surface of lower wall
21, 45 . . . drainage port
21F . . . front edge part (opening edge of drainage port)
22 . . . water guide
23 . . . water guiding surface
24 . . . reinforcing rib
25 . . . flow-down surface
30 . . . fit-in side housing
31 . . . terminal accommodating portion
45U . . . upper edge
46 . . . auxiliary water guide

What is claimed is:

1. A connector (10, 40), comprising:

a waiting side housing (11, 41) including a forwardly open receptacle (13, 43) mounted in a mounting hole (H) of a panel (P);

a fit-in side housing (30) including a terminal accommodating portion (31) fittable into the receptacle (13, 43);

a drainage port (21, 45) formed in a lower wall (16) of the receptacle (13, 43); and a water guide (22) projecting into an opening area of the drainage port (21, 45) only from a part of an opening edge (21F) of the drainage port (21, 45), an upper surface of the water guide (22) defining a water guiding surface (23) connected to an upper surface (16S) of the lower wall (16).

2. The connector (10, 40) of claim 1, wherein the water guiding surface (23) is inclined down into the opening area of the drainage port (23) from the opening edge of the drainage port (21).

3. The connector (10, 40) of claim 2, wherein the water guiding surface (23) is connected at an obtuse angle to the upper surface (16S) of the lower wall (16).

4. The connector (10, 40) of claim 3, wherein the water guide (22) has a flow-down surface (25) extending down from a projecting end of the water guiding surface (23).

5. The connector (10, 40) of claim 4, further comprising a reinforcement (24) from a projecting from lower surface of the lower wall (16) and connected to a lower end part of the water guide (22).

6. The connector (10, 40) of claim 5, wherein:

the receptacle (13, 43) includes a back wall (14, 44) connected to a rear end part of the lower wall (16);

the drainage port (21, 45) also is open in a lower end part of the back wall (14, 44); and the back wall (14, 44) is formed with an auxiliary water guide (46) projecting down into the opening area of the drainage port (21, 45) only from a part of an upper edge (45U) the opening edge of the drainage port (21, 45).

* * * * *